US007762060B2

(12) United States Patent
Easley, Jr. et al.

(10) Patent No.: US 7,762,060 B2
(45) Date of Patent: Jul. 27, 2010

(54) EXHAUST TREATMENT SYSTEM

(75) Inventors: William L. Easley, Jr., Dunlap, IL (US); Maarten Verkiel, Metamora, IL (US); Aaron D. Strauser, Washington, IL (US); James J. Driscoll, Dunlap, IL (US); Wade J. Robel, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 44 days.

(21) Appl. No.: 11/412,883

(22) Filed: Apr. 28, 2006

(65) Prior Publication Data

US 2007/0251216 A1 Nov. 1, 2007

(51) Int. Cl.
*F01N 3/00* (2006.01)

(52) U.S. Cl. ..... 60/285; 60/274; 60/286; 60/295; 60/300; 60/311

(58) Field of Classification Search ..... 60/274, 60/285, 286, 295, 297, 300, 311
See application file for complete search history.

(56) References Cited

U.S. PATENT DOCUMENTS

| | | | |
|---|---|---|---|
| 3,765,386 | A | 10/1973 | Ottofy |
| 3,769,798 | A | 11/1973 | Whittaker |
| 3,779,015 | A | 12/1973 | Maruoka |
| 3,844,260 | A | 10/1974 | Scott, Jr. et al. |
| 3,864,980 | A | 2/1975 | Barnes |
| 3,903,858 | A | 9/1975 | Hecht |
| 3,911,675 | A | 10/1975 | Mondt |
| 4,011,846 | A | 3/1977 | Gagliardi |
| 4,092,962 | A | 6/1978 | Beaton et al. |
| 4,136,650 | A | 1/1979 | Manookian, Jr. |
| 4,211,075 | A | 7/1980 | Ludecke et al. |
| 4,270,508 | A | 6/1981 | Lindberg |
| 4,363,310 | A | 12/1982 | Thurston |
| 4,512,325 | A | 4/1985 | DePakh |

(Continued)

FOREIGN PATENT DOCUMENTS

| | | |
|---|---|---|
| DE | 102004019659 | 12/2004 |

(Continued)

OTHER PUBLICATIONS

PCT International Search Report, PCT/US2007/006485; International Filing Date: Mar. 14, 2007; Applicant: Caterpillar Inc.

*Primary Examiner*—Binh Q Tran
(74) *Attorney, Agent, or Firm*—Finnegan, Henderson, Farabow, Garrett & Dunner

(57) ABSTRACT

An exhaust treatment system is provided. The system may include a particulate trap configured to remove one or more types of particulate matter from an exhaust flow of an engine. The system may also include a catalyst configured to chemically alter at least one component of the exhaust flow. Further, the system may include an exhaust conduit configured to direct the exhaust flow from the engine to the particulate trap and the catalyst. In addition, the exhaust treatment system may include a heating system configured to maintain the temperature of the catalyst above a first predetermined temperature. The heating system may also be configured to periodically raise the temperature of the particulate trap above a higher, second predetermined temperature to thereby effectuate a regeneration of the particulate trap by oxidizing particulate matter accumulated in the particulate trap.

20 Claims, 3 Drawing Sheets

U.S. PATENT DOCUMENTS

| | | | | |
|---|---|---|---|---|
| 4,517,951 | A | 5/1985 | Otaka et al. | |
| 4,535,588 | A | 8/1985 | Sato et al. | |
| 4,557,226 | A | 12/1985 | Mayer et al. | |
| 4,558,681 | A | 12/1985 | Mookerjee | |
| 4,570,603 | A | 2/1986 | Piedrafita | |
| 4,608,640 | A | 8/1986 | Shinzawa et al. | |
| 4,616,620 | A | 10/1986 | Paoluccio | |
| 4,677,823 | A | 7/1987 | Hardy | |
| 4,811,697 | A | 3/1989 | Kurahashi | |
| 5,027,783 | A | 7/1991 | von Riesen | |
| 5,085,049 | A | 2/1992 | Rim et al. | |
| 5,205,265 | A | 4/1993 | Kashiyama et al. | |
| 5,251,564 | A | 10/1993 | Rim et al. | |
| 5,261,230 | A | 11/1993 | Yuuki et al. | |
| 5,390,488 | A | 2/1995 | Ament et al. | |
| 5,417,184 | A | 5/1995 | McDowell | |
| 5,419,121 | A | 5/1995 | Sung et al. | |
| 5,428,955 | A | 7/1995 | Yuuki et al. | |
| 5,435,130 | A | 7/1995 | Kroiss et al. | |
| 5,444,976 | A | 8/1995 | Gonze et al. | |
| 5,494,020 | A | 2/1996 | Meng | |
| 5,553,451 | A | 9/1996 | Haranda | |
| 5,582,145 | A | 12/1996 | Aizawa et al. | |
| 5,657,625 | A | 8/1997 | Koga et al. | |
| 5,771,683 | A | 6/1998 | Webb | |
| 5,802,844 | A | 9/1998 | Lee et al. | |
| 5,803,025 | A | 9/1998 | Feucht | |
| 5,806,308 | A | 9/1998 | Khair et al. | |
| 5,811,884 | A | 9/1998 | Matuoka et al. | |
| 5,826,428 | A | 10/1998 | Blaschke | |
| 5,860,396 | A | 1/1999 | Muth | |
| 5,927,075 | A | 7/1999 | Khair | |
| 5,941,219 | A | 8/1999 | Takebe | |
| 5,966,931 | A | 10/1999 | Yoshizaki et al. | |
| 6,129,058 | A | 10/2000 | Muth | |
| 6,155,213 | A | 12/2000 | Tanis | |
| 6,167,696 | B1 * | 1/2001 | Maaseidvaag et al. | 60/274 |
| 6,247,463 | B1 | 6/2001 | Fedorowicz et al. | |
| 6,276,130 | B1 | 8/2001 | Ito et al. | |
| 6,304,815 | B1 | 10/2001 | Moraal et al. | |
| 6,314,722 | B1 * | 11/2001 | Matros et al. | 60/274 |
| 6,338,245 | B1 | 1/2002 | Shimoda et al. | |
| 6,345,614 | B1 | 2/2002 | Shureb | |
| 6,354,283 | B1 | 3/2002 | Hawkins et al. | |
| 6,381,955 | B1 | 5/2002 | Morganti et al. | |
| 6,412,276 | B1 | 7/2002 | Salvat et al. | |
| 6,427,436 | B1 | 8/2002 | Allansson et al. | |
| 6,439,174 | B1 | 8/2002 | Shea et al. | |
| 6,457,462 | B2 | 10/2002 | Moren | |
| 6,478,019 | B2 | 11/2002 | Fedorowicz et al. | |
| 6,527,821 | B2 | 3/2003 | Liu et al. | |
| 6,530,366 | B2 | 3/2003 | Geiger et al. | |
| 6,553,978 | B2 | 4/2003 | Takashiba | |
| 6,568,173 | B1 | 5/2003 | Kolmanovsky et al. | |
| 6,574,956 | B1 | 6/2003 | Moraal et al. | |
| 6,581,372 | B2 * | 6/2003 | Sasaki et al. | 60/278 |
| 6,588,201 | B2 | 7/2003 | Gillespie | |
| 6,594,990 | B2 * | 7/2003 | Kuenstler et al. | 60/295 |
| 6,598,396 | B2 | 7/2003 | Bailey | |
| 6,625,978 | B1 | 9/2003 | Eriksson et al. | |
| 6,644,020 | B2 | 11/2003 | Kuenstler et al. | |
| 6,647,973 | B1 | 11/2003 | Schueler et al. | |
| 6,691,687 | B1 | 2/2004 | Liang et al. | |
| 6,694,957 | B2 | 2/2004 | Schueler et al. | |
| 6,718,757 | B2 | 4/2004 | Khair et al. | |
| 6,729,125 | B2 | 5/2004 | Suga et al. | |
| 6,729,316 | B1 | 5/2004 | Knowles | |
| 6,738,702 | B2 | 5/2004 | Kolmanovsky et al. | |
| 6,816,771 | B2 | 11/2004 | Miura et al. | |
| 6,823,660 | B2 * | 11/2004 | Minami | 60/280 |
| 6,851,415 | B2 | 2/2005 | Mahakul et al. | |
| 6,857,263 | B2 | 2/2005 | Gray, Jr. et al. | |
| 6,862,881 | B1 | 3/2005 | Klingbeil et al. | |
| 6,865,883 | B2 * | 3/2005 | Gomulka | 60/295 |
| 6,893,715 | B2 | 5/2005 | Inoue et al. | |
| 6,895,745 | B2 * | 5/2005 | Roby | 60/280 |
| 6,898,508 | B2 | 5/2005 | Nakano et al. | |
| 6,907,869 | B2 | 6/2005 | Burgess et al. | |
| 6,915,629 | B2 * | 7/2005 | Szymkowicz | 60/289 |
| 6,925,994 | B2 | 8/2005 | Michel | |
| 6,928,359 | B2 | 8/2005 | Xu et al. | |
| 6,966,310 | B2 | 11/2005 | Moren | |
| 6,994,078 | B2 | 2/2006 | Roberts et al. | |
| 7,013,638 | B2 * | 3/2006 | Hiranuma et al. | 60/286 |
| 7,054,734 | B2 * | 5/2006 | Todoroki et al. | 701/105 |
| 7,100,365 | B2 * | 9/2006 | Nishizawa et al. | 60/285 |
| 7,121,083 | B2 * | 10/2006 | Ishibashi et al. | 60/285 |
| 7,441,403 | B2 * | 10/2008 | Sun et al. | 60/295 |
| 2003/0084661 | A1 | 5/2003 | Brehob | |
| 2003/0140621 | A1 | 7/2003 | Khair et al. | |
| 2003/0140622 | A1 | 7/2003 | Taylor, III et al. | |
| 2004/0050375 | A1 | 3/2004 | Arnold | |
| 2004/0103648 | A1 | 6/2004 | Opris et al. | |
| 2004/0103651 | A1 | 6/2004 | Bennett et al. | |
| 2004/0133335 | A1 | 7/2004 | Nakano et al. | |
| 2004/0139734 | A1 | 7/2004 | Schmeichel et al. | |
| 2004/0144086 | A1 | 7/2004 | Otake et al. | |
| 2004/0144087 | A1 | 7/2004 | Kondou et al. | |
| 2004/0163378 | A1 | 8/2004 | Sasaki et al. | |
| 2004/0204818 | A1 | 10/2004 | Trudell et al. | |
| 2004/0231328 | A1 | 11/2004 | Reider et al. | |
| 2004/0244362 | A1 | 12/2004 | Hiranuma et al. | |
| 2004/0260452 | A1 | 12/2004 | Hamahata | |
| 2005/0000497 | A1 | 1/2005 | Nakai et al. | |
| 2005/0027431 | A1 | 2/2005 | Todoroki et al. | |
| 2005/0056004 | A1 | 3/2005 | Kakwani et al. | |
| 2005/0056017 | A1 | 3/2005 | Sisken et al. | |
| 2005/0102076 | A1 | 5/2005 | Kariya et al. | |
| 2005/0109015 | A1 | 5/2005 | Birkby | |
| 2005/0109020 | A1 | 5/2005 | Ichise et al. | |
| 2005/0120712 | A1 | 6/2005 | Tsutsumoto et al. | |
| 2006/0064966 | A1 | 3/2006 | Opris | |
| 2007/0130946 | A1 | 6/2007 | Winsor et al. | |
| 2007/0186538 | A1 | 8/2007 | Dollmeyer et al. | |
| 2007/0214772 | A1 | 9/2007 | England | |

FOREIGN PATENT DOCUMENTS

| | | |
|---|---|---|
| DE | 102005013707 | 9/2006 |
| EP | 0 758 713 A1 | 2/1997 |
| EP | 1344909 | 9/2003 |
| EP | 1 460 245 A1 | 9/2004 |
| EP | 1420150 | 5/2005 |
| JP | 2005240583 | 9/2005 |
| WO | 2004027228 | 4/2004 |
| WO | WO 2004/067927 A1 | 8/2004 |

* cited by examiner

EXHAUST TREATMENT SYSTEM

TECHNICAL FIELD

The present disclosure is directed to an exhaust treatment system and, more particularly, to an exhaust treatment system including a heating system.

BACKGROUND

Engines, including diesel engines, gasoline engines, natural gas engines, and other engines known in the art, may exhaust a complex mixture of air pollutants. The air pollutants may be composed of both gaseous and solid material, such as, for example, particulate matter. Particulate matter may include ash and unburned carbon particles called soot.

Due to increased environmental concerns, exhaust emission standards have become more stringent. The amount of particulate matter and gaseous pollutants emitted from an engine may be regulated depending on the type, size, and/or class of engine. In order to meet these emissions standards, engine manufacturers have pursued improvements in several different engine technologies, such as fuel injection, engine management, and air induction, to name a few. In addition, engine manufacturers have developed devices for treatment of engine exhaust after it leaves the engine.

Engine manufacturers have employed exhaust treatment devices called particulate traps to remove the particulate matter from the exhaust flow of an engine. A particulate trap may include a filter designed to trap particulate matter. The use of the particulate trap for extended periods of time, however, may enable particulate matter to accumulate on the filter, thereby causing damage to the filter and/or a decline in engine performance.

One method of restoring the performance of a particulate trap may include regeneration. Regeneration of a particulate trap filter system may be accomplished by thermal regeneration, which may include periodically increasing the temperature of the filter, and the trapped particulate matter in the filter, above the combustion temperature of the particulate matter, thereby burning away the collected particulate matter and regenerating the filter system. This increase in temperature may be effectuated by various means. For example, some systems employ a heating system (e.g., an electric heating element) to directly heat one or more portions of the particulate trap (e.g., the filter material or the external housing). Other systems have been configured to heat the exhaust gases upstream from the particulate trap, allowing the flow of the heated gases through the particulate trap to transfer heat to the particulate trap. For example, some systems may alter one or more engine operating parameters, such as air/fuel mixture, to produce exhaust gases with an elevated temperature. Other systems heat the exhaust gases upstream from the particulate trap, with the use of a burner that creates a flame within the exhaust conduit leading to the particulate trap.

In addition to particulate traps, exhaust systems may also include other types of after-treatment devices, such as catalyst-based devices. Catalyst-based devices, such as oxidation or reduction catalysts, may be utilized to convert (e.g., via oxidation or reduction) one or more gaseous constituents of an exhaust stream to a more environmentally friendly gas and/or compound to be discharged into the atmosphere. Such catalytic conversion reactions often occur more efficiently above a particular temperature and/or within a particular temperature range. During some situations, such as cold start or idle, an engine may not produce exhaust gases hot enough to maintain the catalyst above the particular temperature or within the desired temperature range. The same types of heating systems discussed above with regard to thermal regeneration have been used in some exhaust treatment systems to maintain the temperature of a catalyst-based device within a desired temperature range to promote favorable conversion efficiency. For example, one such system is disclosed by U.S. Pat. No. 5,771,683 issued to Webb on Jun. 30, 1998 ("the '683 patent"). The '683 patent discloses an exhaust treatment system including a burner device configured to heat a catalyst or, in the case of diesel engines, a particulate trap. However, the system of the '683 patent does not disclose a system including a heating device or system configured to both heat a catalyst, thus maintaining it above a predetermined temperature, and heat a particulate trap in order to effectuate regeneration. Therefore, the '683 patent does not provide an exhaust treatment system capable of controlling a heating system to perform multiple functions. As such, the '683 patent is limited to enhancing either one type of exhaust treatment or another, but not both.

The present disclosure is directed to solving one or more of the problems discussed above.

SUMMARY OF THE INVENTION

In one aspect, the present disclosure is directed to an exhaust treatment system. The system may include a particulate trap configured to remove one or more types of particulate matter from an exhaust flow of an engine. The system may also include a catalyst configured to chemically alter at least one component of the exhaust flow. Further, the system may include an exhaust conduit configured to direct the exhaust flow from the engine to the particulate trap and the catalyst. In addition, the exhaust treatment system may include a heating system configured to maintain the temperature of the catalyst above a first predetermined temperature. The heating system may also be configured to periodically raise the temperature of the particulate trap above a higher, second predetermined temperature to thereby effectuate a regeneration of the particulate trap by oxidizing particulate matter accumulated in the particulate trap.

In another aspect, the present disclosure is directed to a method for treating an exhaust flow produced by an engine. The method may include directing the exhaust flow from the engine to a particulate trap configured to remove one or more types of particulate matter from the exhaust flow and to a catalyst configured to chemically alter at least one component of the exhaust flow. The method may also include maintaining the temperature of the catalyst above a first predetermined temperature. The method may further include periodically raising the temperature of the particulate trap above a higher, second predetermined temperature to thereby effectuate a regeneration of the particulate trap by oxidizing particulate matter accumulated in the particulate trap.

DETAILED DESCRIPTION

Reference will now be made in detail to the drawings. Wherever possible, the same reference numbers will be used throughout the drawings to refer to the same or like parts.

Figure 1:
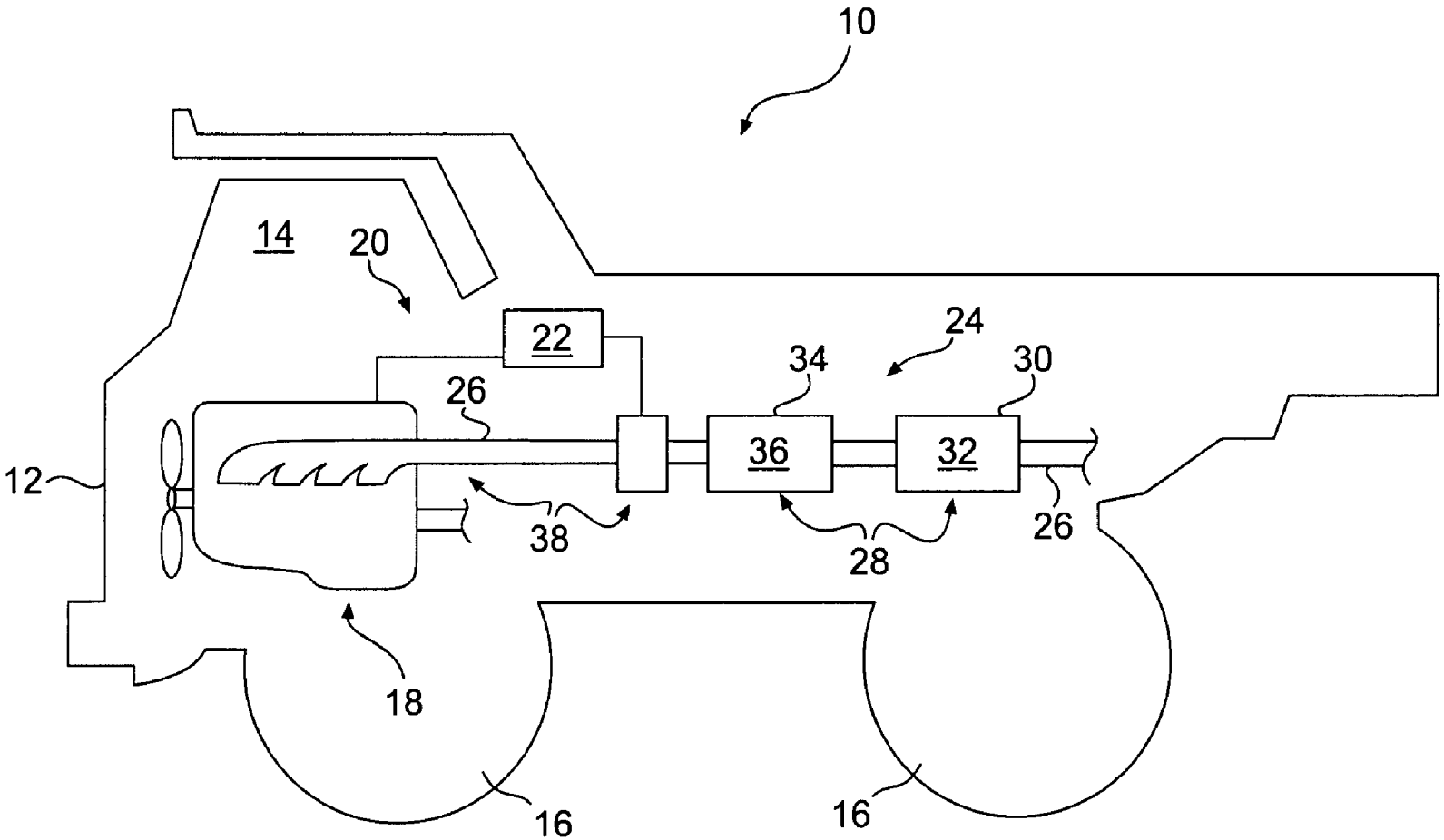
FIG. 1 is a diagrammatic illustration of a machine according to an exemplary disclosed embodiment.

FIG. 1 illustrates a machine 10 including a frame 12, an operator station 14, one or more traction devices 16, an engine 18, and an exhaust treatment system 20. Although machine 10 is shown as a truck, machine 10 could be any type of mobile or stationary machine having an exhaust producing engine. In the case of a mobile machine, traction devices 16 may be any type of traction devices, such as, for example, wheels, as shown in FIG. 1, tracks, belts, or any combinations thereof.

Engine 18 may be mounted to frame 12 and may include any kind of engine that produces an exhaust flow of exhaust gases. For example, engine 18 may be an internal combustion engine, such as a gasoline engine, a diesel engine, a gaseous-fuel driven engine or any other exhaust gas producing engine. Engine 18 may be naturally aspirated or, in other embodiments, may utilize forced induction (e.g., turbocharging or supercharging).

Exhaust treatment system 20 may include a controller 22, an exhaust system 24, which may include, among other things, an exhaust conduit 26, and two or more after-treatment devices 28. These and other components of exhaust treatment system 20 will be discussed in greater detail below in conjunction with FIGS. 2A and 3A.

Controller 22 may include any means for receiving machine operating parameter-related information and/or for monitoring, recording, storing, indexing, processing, and/or communicating such information. These means may include components such as, for example, a memory, one or more data storage devices, a central processing unit, and/or any other components that may be used to run an application.

Although aspects of the present disclosure may be described generally as being stored in memory, one skilled in the art will appreciate that these aspects can be stored on or read from types of computer program products or computer-readable media, such as computer chips and secondary storage devices, including hard disks, floppy disks, optical media, CD-ROM, and/or other forms of RAM or ROM. Various other known circuits may be associated with controller 22, such as power supply circuitry, signal-conditioning circuitry, solenoid driver circuitry, communication circuitry, and other appropriate circuitry.

Controller 22 may be configured to perform multiple processing and controlling functions, such as, for example, engine management (e.g., controller 22 may include an engine control module, a.k.a. an ECM), monitoring/calculating various parameters related to exhaust output and after-treatment thereof, etc. In some embodiments, machine 10 may include multiple controllers (a configuration not shown), each dedicated to perform one or more of these or other functions. Such multiple controllers may be configured to communicate with one another.

After-treatment devices 28 may include a catalyst-based device 30 (e.g., a catalytic converter). Catalyst-based device 30 may include a catalyst 32 configured to convert (e.g., via oxidation or reduction) one or more gaseous constituents of the exhaust stream produced by engine 18 to a more environmentally friendly gas and/or compound to be discharged into the atmosphere. For example, catalyst 32 may be configured to chemically alter at least one component of the exhaust flow. Catalyst-based device 30 may be configured for one or more various types of conversion, such as, for example, select catalytic reduction (SCR), diesel oxidation (e.g., a diesel oxidation catalyst, DOC), and/or adsorption of nitrous oxides ($NO_x$; e.g., a $NO_x$ adsorber).

After-treatment devices 28 may also include a particulate trap 34. Particulate trap 34 may include any type of after-treatment device configured to remove one or more types of particulate matter, such as soot and/or ash, from an exhaust flow of engine 18. Particulate trap may include a filter medium 36 configured to trap the particulate matter as the exhaust flows through it. Filter medium may consist of a mesh-like material, a porous ceramic material (e.g., cordierite), or any other material and/or configuration suitable for trapping particulate matter.

In some embodiments, after-treatment devices 24 may include combinations of these types of devices. For example, after-treatment devices 28 may include one or more catalytic particulate traps (not shown), which may include a catalytic material integral with filter medium 36. For example, catalyst 32 may be packaged with, coated on, or otherwise associated with filter medium 36. In some embodiments, filter medium 36 may, itself, be a catalytic material. In addition, although exhaust treatment system 20 is shown with a single catalyst-based device 30 and a single particulate trap 34, system 20 may include more than one of either or both. In other embodiments, system 20 may include more than one catalytic particulate trap. Such multiple after-treatment devices may be positioned in series (e.g., along exhaust conduit 26) or in parallel (e.g., in dual exhaust conduits; an embodiment not shown). In some embodiments, catalyst 32 may be positioned downstream from particulate trap 34. In other embodiments, catalyst 32 may be positioned upstream from particulate trap 34. Other embodiments may include catalysts both upstream and downstream from particulate trap 34.

Exhaust conduit 26 may be configured to direct the exhaust flow from engine 18 to particulate trap 34 and to catalyst 32. Exhaust treatment system 20 may also include a heating system 38 configured to raise the temperature of the catalyst above a first predetermined temperature. Heating system 38 may also be configured to maintain the temperature of catalyst 32 within a predetermined temperature range. In addition, heating system 38 may be configured to periodically raise the temperature of particulate trap 34 above a higher, second predetermined temperature to thereby effectuate a regeneration of particulate trap 34 by oxidizing particulate matter accumulated in particulate trap 34.

Figure 2A:
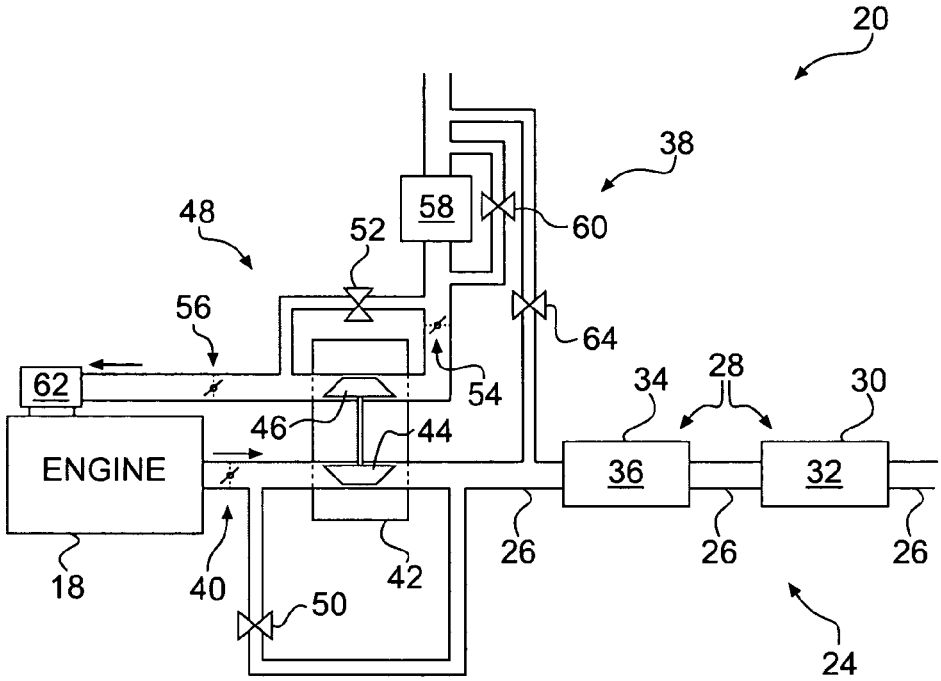
FIG. 2A is a block diagram representation of an exhaust treatment system according to an exemplary disclosed embodiment.

FIG. 2A is a block diagram of an embodiment of system 20 wherein heating system 38 may be configured to control one or more engine operating parameters, e.g., via controller 22, to produce exhaust gases with a higher temperature. Such engine operating parameters may include, for example, engine speed, spark timing, compression ratio, parasitic load, fuel injection, air induction, exhaust flow, air-fuel ratio, etc.

Engine speed may be regulated to control exhaust temperatures. For example, in some embodiments, engine speed may be lowered and engine load may be maintained or increased, to produce higher exhaust temperatures. Also, in some embodiments, engine 18 may utilize spark plugs (not shown) for initiating combustion. In such embodiments, spark timing may be controlled to affect exhaust temperatures. In addition, some embodiments may be configured to vary compression ratio to effect exhaust temperatures. Such embodiments may do so by utilizing any suitable mechanism, such as, for example, a movable crankshaft (not shown), which may vary combustion chamber clearance volume.

Parasitic load on engine 18 may be increased to increase exhaust temperatures. Parasitic load may be increased by one or more mechanisms, such as, for example, a brakesaver, a compression brake, fan load, fuel system parasitics (e.g., making an engine-driven fuel pumping mechanism work harder than needed for combustion), and cylinder cutout.

Fuel injection may be used to control exhaust temperatures by controlling various aspects of the injection. For example, controller 22 may be configured to control such aspects of fuel injection as injection timing, duration, quantity, pressure, and number of injections. Examples of fuel injection strategies that may be employed at various stages of engine operation may include one or more of the following: early injection for homogeneous charge compression injection (HCCI) and multiple injections including, but not limited to pilot injection and post injection, etc.

One engine operating parameter that may be affected by fuel injection strategies is air-fuel ratio. Air-fuel ratio may be varied by controlling the amount of fuel delivered to engine 18 relative to the amount of air delivered. Use of a lower air-fuel ratio (i.e., a richer mixture) may result in higher exhaust temperatures. Accordingly, heating system 38 may be configured to increase the amount of fuel and/or decrease the amount of air in order to increase exhaust temperatures at predetermined times and in predetermined amounts.

As an alternative to or in addition to the various fuel injection strategies discussed above, airflow (i.e., air induction and/or exhaust flow) may be regulated via one or more mechanisms. Such mechanisms may include variable actuation of intake valves (a.k.a. intake valve actuation (IVA)), variable actuation of exhaust valves (a.k.a. exhaust valve actuation (EVA)), and/or actuation of an exhaust throttle valve 40, any of which may be controlled by controller 22.

Figure 3A:
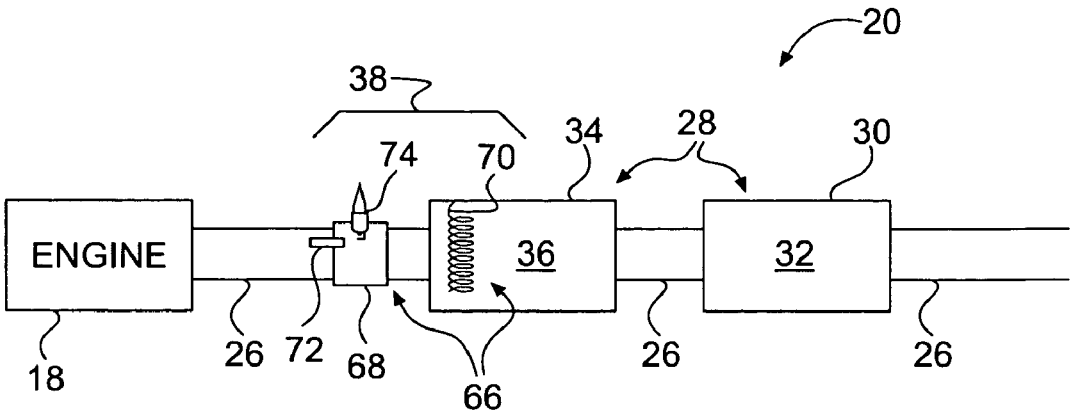
FIG. 3A is a block diagram representation of an exhaust treatment system according to another exemplary disclosed embodiment.

In embodiments where engine 18 features forced induction, system 20 may include a compressor device such as a turbocharger 42. Alternatively or additionally, some embodiments may include a supercharger (not shown) or any other type of compressor device. Turbocharger 42 may include a turbine wheel 44, which may be located in exhaust conduit 26 and a compressor wheel 46, which may be located in an air intake system 48. In such embodiments, other aspects of air flow may be controllable to affect exhaust temperatures. Boost pressure is one aspect of air flow that may be controllable in a number of different ways. For example, boost pressure may be controlled by using a wastegate 50, a compressor bypass valve 52, variable geometry turbine or compressor wheels (e.g., variable turbine/compressor blade pitch angle), a pre-compressor throttle valve 54, a post-compressor throttle valve 56, and/or other mechanisms. It should be noted that, although components such as exhaust throttle valve 40 and wastegate 50 are located downstream from engine 18, for purposes of this disclosure, such components will be considered to be heating mechanisms configured to control engine operating parameters (as opposed to heating mechanisms configured to apply heat to system 20 at a location downstream from engine 18 as illustrated in FIG. 3A) because of their effect on engine performance.

In addition, other active and/or passive heating mechanisms may be employed. For example, in some embodiments, air intake system 48 may include an air to air after cooler (ATAAC) 58. In such embodiments, heating system 38 may include an ATAAC bypass valve 60 to reduce or eliminate cooling of intake air at predetermined times and/or under predetermined operating conditions. An intake air heater 62 may also be used periodically or continuously with constant or variable intensity to facilitate production of exhaust gases with increased temperatures.

Further, recirculation of exhaust gases (e.g., via an exhaust gas recirculation (EGR) system 64, a.k.a. a clean gas induction (CGI) system) may be regulated to affect exhaust gas temperatures. EGR system 64 may draw exhaust gases from any location along exhaust conduit 26. For example, EGR system 64 may be configured to draw exhaust gases from a location downstream of turbine wheel 44, as shown in FIG. 2A. Such a configuration may be considered a low pressure system, which may be configured to route exhaust gases back to air intake system 48 at a location upstream of compressor wheel 46, as shown in FIG. 2A. In addition or as an alternative, EGR system 64 may be configured to draw exhaust gases from a location downstream of particulate trap 34 and/or catalyst-based device 30. This configuration may also be considered a low pressure system and, thus, may be configured to route exhaust gases back to air intake system 48 at a location upstream of compressor wheel 46. Alternatively or additionally, in other embodiments, EGR system 64 may be configured to draw exhaust gases from a location upstream of turbine wheel 44. Such a configuration may be considered a high pressure system, which may be configured to route exhaust gases to air intake system 48 at a location downstream of compressor wheel 46.

Figure 2B:
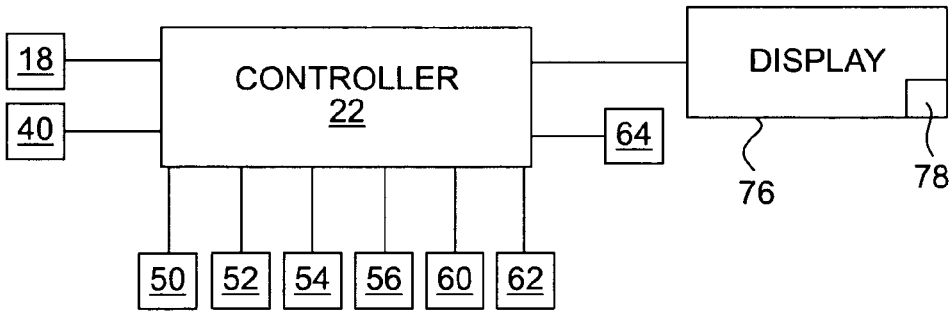
FIG. 2B is an exemplary block diagram representation of a controller and its interconnections with various components illustrated in FIG. 2A.

FIG. 2B is an exemplary block diagram representation of controller 22 and its interconnections with various components illustrated in FIG. 2A. Controller 22 may be configured to control engine 18, exhaust throttle 40, wastegate 50, compressor bypass valve 52, pre-compressor throttle valve 54, post-compressor throttle valve 56, ATAAC bypass valve 60, intake air heater 62, EGR system 64, and/or any other system or component of system 20 configured to facilitate production of exhaust gases with increased temperatures. It should be noted that although FIG. 2A illustrates many different heating mechanisms, heating system 38 may include/employ any one or more of these and/or other heating mechanisms.

FIG. 3A is a block diagram of an embodiment of system 20 wherein heating system 38 may include a heating mechanism 66 configured to apply heat to system 20 at a location downstream from engine 18. It should be noted that, although FIG. 3A does not show many of the heating mechanisms illustrated in FIG. 2A, any of those mechanisms may be used in conjunction with the embodiment illustrated in FIG. 3A. Heating mechanism 66 may include one or more of the following: a flame producing burner 68, an electrical heating element 70, and/or any other device or mechanism configured to apply heat to system 20 at a location downstream from engine 18. It should be noted that although burner 68 has been described as producing a flame, other types of burners could be used, such as a plasma burner.

Burner 68 may be located anywhere along exhaust conduit 26 between engine 18 and whichever of after-treatment devices 28 is farthest upstream. Burner 68 may be configured to produce a flame, which may heat exhaust gases in exhaust conduit 26 and/or heat various components of exhaust treatment system 20. Burner 68 may include a fuel injector 72 and an ignition device 74, such as a spark plug, glow plug, or any other means for igniting an air/fuel mixture.

Electrical heating element 70 may also be located in a number of positions. For example, in some embodiments, electrical heating element 70 may be located within or around exhaust conduit 26 at any point between engine 18 and whichever of after-treatment devices 28 is farthest upstream. In other embodiments, electrical heating element 70 may be located in, around, and/or integral with one or more of after-treatment devices 28.

Figure 3B:
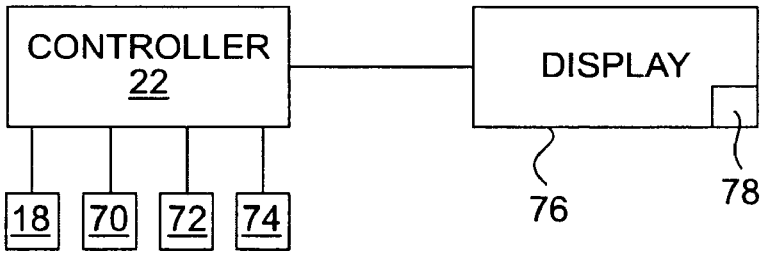
FIG. 3B is an exemplary block diagram representation of a controller and its interconnections with various components illustrated in FIG. 3A.

FIG. 3B is an exemplary block diagram representation of controller 22 and its interconnections with various components illustrated in FIG. 3A. Controller 22 may be configured to control engine 18, electrical heating element 70, fuel injector 72, ignition device 74, and any other system or component configured to apply heat to system 20. In addition to these interconnections with various components illustrated in FIG. 2A and FIG. 3A, controller 22 may be operatively connected to a display 76. Display 76 may be located at any suitable location on machine 10, such as, for example, in operator station 14. Display 76 may be any kind of display, including screen displays, such as, for example, cathode ray tubes (CRTs), liquid crystal displays (LCDs), plasma screens, and the like. Display 76 may be configured to display information about operating parameters of system 20. In one embodiment, display 76 may include a warning indicator 78 (e.g., a warning lamp, warning message, etc.). Controller 22 may be configured to illuminate warning indicator 78 upon detection of one or more faults. As an alternative to or in addition to display 76, system 20 may include one or more audible alerts for conveying information about operating parameters of system 20 to an operator. In addition to providing visual feedback regarding operating parameters of system 20, display 76 may also be configured to display other information regarding system 20 or any other device and/or system associated with machine 10.

INDUSTRIAL APPLICABILITY

The disclosed exhaust treatment system 20 may be suitable to enhance exhaust emissions control for engines. System 20 may be used for any application of an engine. Such applications may include supplying power for machines, such as, for example, stationary equipment such as power generation sets, or mobile equipment, such as vehicles. The disclosed system may be used for any kind of vehicle, such as, for example, automobiles, construction machines (including those for on-road, as well as off-road use), and other heavy equipment.

Not only may the disclosed system be applicable to various applications of an engine, but the disclosed system may be applicable to various types of engines as well. For example, system 20 may be applicable to any exhaust producing engine, which may include gasoline engines, diesel engines, gaseous-fuel driven engines, hydrogen engines, etc. System 20 may also be applicable to a variety of engine configurations, including various cylinder configurations, such as "V" cylinder configurations (e.g., V6, V8, V12, etc.), inline cylinder configurations, and horizontally opposed cylinder configurations. System 20 may also be applicable to engines with a variety of induction types. For example, system 20 may be applicable to normally aspirated engines, as well as those with forced induction (e.g., turbocharging or supercharging). Engines to which system 20 may be applicable may include combinations of these configurations (e.g., a turbocharged, inline-6 cylinder, diesel engine).

The disclosed system may also be applicable to various exhaust path configurations. For example, the disclosed system may be applicable to exhaust systems that employ a single exhaust conduit (e.g., the exhaust from each cylinder ultimately feeds into a single conduit, such as after an exhaust manifold). The disclosed system may also be applicable to dual exhaust systems (e.g., different groups of cylinders may feed into separate exhaust conduits). In such systems, many of the components of the disclosed system may be provided in duplicate (e.g., one catalyst-based device for each exhaust conduit, one particulate trap for each conduit, etc.).

Further, where appropriate, the disclosed system may provide more than one of certain components that have been shown and discussed herein as singular components. For example, in any given embodiment, system 20 may include more than one catalyst-based device 30 and/or more than one particulate trap 34, regardless of the exhaust configuration utilized in that embodiment.

During some situations, such as cold start or idle, engines may not be capable of producing exhaust gases that are hot enough to maintain a catalyst above a desired temperature or maintain the catalyst within a predetermined temperature range. The types of heating systems discussed herein may be used to raise the temperature of catalyst-based devices above a first predetermined temperature and/or to maintain the temperature within a predetermined temperature range to promote catalytic conversion efficiency, even at times when engine exhaust would not otherwise be hot enough to enable such efficiency. Such heating systems may also be used to periodically raise temperatures above a higher, second predetermined temperature or above the predetermined temperature range in order to effectuate regeneration of a particulate trap.

While changes in operating conditions of machine 10 may necessitate variations in engine operating parameters that may, as a byproduct, result in fluctuations in exhaust temperatures, controller 22 may be configured to control engine operating parameters to regulate exhaust temperatures regardless of the operating conditions of machine 10. That is, controller 22 may be configured to control engine operating parameters to purposely regulate exhaust temperatures rather than simply causing fluctuations in exhaust temperatures to occur as a byproduct. For example, increased engine loads, e.g., due to high payloads, may result in elevated exhaust temperatures. However, some engines may never experience particularly high loads or even any fluctuations in engine load (e.g., in a power generation set, the engine may run at a constant engine speed and load). Further, engines that do experience increased loads may only experience such loads rarely and/or at non-regular intervals. Therefore, controller 22 may be configured to control engine operating parameters to produce exhaust with predetermined temperatures regardless of engine load and other such parameters that may affect exhaust temperatures.

Under certain conditions, set points for various engine operating parameters or other aspects of heating system 38 that are conducive to creating high exhaust temperatures and/or are otherwise conducive to supplying heat to one or more after-treatment devices may be less than optimum for other aspects of engine and/or machine operation, such as fuel efficiency and/or power output. For example, while running engine 18 with a richer air/fuel mixture may result in higher exhaust temperatures, it may consume more fuel, and thus, may adversely affect fuel efficiency. Similarly, increasing parasitic load on engine 18 may result in lower power output and/or lower fuel efficiency. That is, under increased parasitic loads, engine 18 may have a reduced power output or controller 22 may be configured to compensate, at least partially, for such reduced power output by adjusting one or more other operating parameters such as engine speed and/or throttle position.

In some embodiments, tradeoffs may be made between emissions control and other aspects of engine operation. For example, in some situations, operation of heating system 38 to control exhaust temperatures and/or application of heat to one or more after-treatment devices may take priority over other aspects of engine operation, such as fuel efficiency and/or power output. In other situations, priority may be reversed. For example, under certain operating conditions, such as when carrying heavy payloads, it may be desirable to have maximum power available from engine 18. Therefore, controller 22 may be configured such that if machine 10 happens to be carrying a particularly heavy payload at a time when a regeneration of particulate trap 34 is triggered, the regeneration event may be delayed until the payload is no longer as heavy. Although priority is described above as being situational, in certain embodiments, emissions control may always take priority over other aspects of engine operation, such as power output and/or fuel efficiency. In other embodiments, such other aspects of engine operation may always take priority over emissions control.

An exemplary method of using system 20 may include directing the exhaust flow from the engine to a particulate trap configured to remove one or more types of particulate matter from the exhaust flow and to a catalyst configured to chemically alter at least one component of the exhaust flow. The method may also include maintaining the temperature of the catalyst above a first predetermined temperature. The method may further include periodically raising the temperature of the particulate trap above a higher, second predetermined temperature to thereby effectuate a regeneration of the particulate trap by oxidizing particulate matter accumulated in the particulate trap.

As described above with regard to FIG. 2A, system 20 may be configured to produce exhaust gases with higher temperatures. An exemplary method of using system 20 for such a purpose may include controlling one or more engine operating parameters. Such engine operating parameters may include one or more of the following: engine speed, spark timing, compression ratio, parasitic load, fuel injection, air induction, exhaust flow, and air-fuel ratio. Controlling air induction may include controlling at least one of the following: intake valves (e.g., regulating intake valve timing), a compressor bypass valve, a variable geometry turbine wheel, a pre-compressor throttle valve, a post-compressor throttle valve, an air to air aftercooler (ATAAC) bypass valve, an intake air heater, and an exhaust gas recirculation (EGR) system. Controlling exhaust flow may include controlling at least one of the following: exhaust valves (e.g., regulating exhaust valve timing), an exhaust throttle valve, and a wastegate.

Alternatively or additionally, system 20 may be configured to apply heat to the exhaust flow produced by engine 18, as described above with regard to FIG. 3A. An exemplary method of using system 20 for such a purpose may include applying heat to the exhaust flow at a location downstream from engine 18. The heat may be applied by a burner and/or an electrical heating element.

It will be apparent to those having ordinary skill in the art that various modifications and variations can be made to the disclosed exhaust treatment system without departing from the scope of the invention. Other embodiments of the invention will be apparent to those having ordinary skill in the art from consideration of the specification and practice of the invention disclosed herein. It is intended that the specification and examples be considered as exemplary only, with a true scope of the invention being indicated by the following claims and their equivalents.

What is claimed is:

1. An exhaust treatment system for an engine, comprising:

a particulate trap configured to remove one or more types of particulate matter from an exhaust flow of an engine;

a catalyst configured to chemically alter at least one component of the exhaust flow;

an exhaust conduit configured to direct the exhaust flow from the engine to the particulate trap and the catalyst; and a heating system located downstream from the engine and upstream from the catalyst, the heating system being configured to:

maintain the temperature of the catalyst above a first predetermined temperature;

and periodically raise the temperature of the particulate trap above a higher, second predetermined temperature to thereby effectuate a regeneration of the particulate trap by oxidizing particulate matter accumulated in the particulate trap.

2. The system of claim 1, wherein the heating system includes a flame producing burner or an electrical heating element.

3. A method for treating an exhaust flow produced by an engine, comprising:

directing the exhaust flow from the engine to a particulate trap configured to remove one or more types of particulate matter from the exhaust flow and to a catalyst configured to chemically alter at least one component of the exhaust flow;

applying heat to the exhaust flow using a heating system located downstream from the engine and upstream from the catalyst, the heating system, maintaining the temperature of the catalyst above a first predetermined temperature, and periodically raising the temperature of the particulate trap above a higher, second predetermined temperature to thereby effectuate a regeneration of the particulate trap by oxidizing particulate matter accumulated in the particulate trap.

4. The method of claim 3, wherein the heating system includes a flame producing burner or an electrical heating element.

5. A machine, comprising:

a frame;

an exhaust producing engine mounted to the frame;

an exhaust treatment system including:

a particulate trap configured to remove one or more types of particulate matter from an exhaust flow of the engine;

a catalyst configured to chemically alter at least one component of the exhaust flow;

an exhaust conduit configured to direct the exhaust flow from the engine to the particulate trap and the catalyst; and a heating system located downstream from the engine and upstream from the catalyst, the heating system being configured to:

maintain the temperature of the catalyst above a first predetermined temperature; and periodically raise the temperature of the particulate trap above a higher, second predetermined temperature to thereby effectuate a regeneration of the particulate trap by oxidizing particulate matter accumulated in the particulate trap.

6. The machine of claim 5, wherein the heating system includes a burner or an electrical heating element.

7. The system of claim 1, further including a controller configured to control the heating system, the controller being operatively coupled to an indicator configured to indicate a state of the exhaust treatment system.

8. The system of claim 1, wherein the catalyst is positioned downstream from the particulate trap.

9. The system of claim 1, wherein the catalyst is positioned upstream from the particulate trap.

10. The system of claim 1, wherein the catalyst includes a first catalyst positioned upstream from the particulate trap and a second catalyst positioned downstream from the particulate trap.

11. The system of claim 1, wherein the catalyst and the particulate trap are integrated together.

12. The system of claim 1, wherein the catalyst is one of a Selective Catalytic Reduction (SCR) or a Diesel Oxidation Catalyst (DOC).

13. The system of claim 1, wherein the heating system is configured to maintain the temperature of the catalyst within a predetermined range above the first predetermined temperature before and after periodically raising the temperature of the particulate trap.

14. The method of claim 3, wherein the catalyst is positioned upstream from the particulate trap.

15. The method of claim 3, wherein the catalyst is positioned downstream from the particulate trap.

16. The method of claim 3, wherein the catalyst and the particulate trap are integrated together.

17. The method of claim 3, wherein maintaining the temperature of the catalyst includes maintaining the temperature of the catalyst within a predetermined range above the first predetermined temperature before and after the periodic raising of the temperature.

18. The machine of claim 5, wherein the catalyst is positioned downstream from the particulate trap.

19. The machine of claim 5, wherein the catalyst and the particulate trap are integrated together.

20. The machine of claim 5, wherein the heating system is configured to maintain the temperature of the catalyst within a predetermined range above a first predetermined temperature before and after periodically raising of the temperature of the particulate trap.

* * * * *